US006651255B1

(12) United States Patent
Schild

(10) Patent No.: US 6,651,255 B1
(45) Date of Patent: Nov. 25, 2003

(54) GLOVE WITH SPECIALIZED AND SELECTIVE INSERTS

(76) Inventor: Shawn Schild, 719 W. Pacific St., Blackfoot, ID (US) 83221

( * ) Notice: Subject to any disclaimer, the term of this patent is extended or adjusted under 35 U.S.C. 154(b) by 0 days.

(21) Appl. No.: 10/413,298

(22) Filed: Apr. 15, 2003

Related U.S. Application Data

(60) Provisional application No. 60/411,360, filed on Sep. 18, 2002.

(51) Int. Cl.[7] ..... A41D 19/00
(52) U.S. Cl. ..... 2/163; 2/160
(58) Field of Search ..... 2/16, 21, 160, 2/161.1–161.6, 163, 167

(56) References Cited

U.S. PATENT DOCUMENTS 4,561,122 A * 12/1985 Stanley et al. ..... 2/20
5,768,711 A * 6/1998 Wissink ..... 2/161.1
5,881,388 A * 3/1999 Pratt ..... 2/163
6,279,166 B1 * 8/2001 Schild ..... 2/163

* cited by examiner

*Primary Examiner*—Katherine Moran
(74) *Attorney, Agent, or Firm*—Tom Hamill, Jr.

(57) ABSTRACT

A glove having a pinky finger, ring finger, middle finger, index finger and thumb receiving portion in communication with a hand receiving portion is provided. The pinky finger, ring finger, middle finger, and index finger receiving portions each have a top panel and a bottom panel, which are connected to form each of the finger receiving portions. An intermediate region of two of the finger receiving portions (ring finger, middle finger) includes a first and second insert. The intermediate region of the other two finger receiving portions (pinky and index fingers) include only a first insert sewn into a bottom panel of the finger receiving portions. It has been found that if an insert was provided in the outer pink and index finger receiving portions the stitching would fail and the glove would tear apart.

9 Claims, 7 Drawing Sheets

GLOVE WITH SPECIALIZED AND SELECTIVE INSERTS

RELATED APPLICATIONS

Applicant claims priority of U.S. provisional patent application No. 60/411,360 filed on Sep. 18, 2002.

Applicant's U.S. Pat. No. 6,297,166 is hereby incorporated by reference.

BACKGROUND OF THE INVENTION

The present invention relates generally to leather gloves, and more particularly, to a leather glove with inserts located about both sides of the middle knuckle portion (proximal interphalangeal joint) of two of the four fingers, and only about one (interior) side of the other two fingers, the inserts are adapted to effect the ease of bending the fingers within the glove. The thumb, although a digit, is not considered a finger for this discussion, and the thumb receiving portion does not have an insert provided on either side.

FIELD OF THE INVENTION

The applicant's previous U.S. Pat. No. 6,297,166 (which is incorporated by reference) includes a pair of inserts about each finger receiving portion of all four fingers on both hands (but not on the thumb). It has been found that the exterior insert on the pinky finger and the index finger often becomes detached due to failure of the stitching. This is the portion of the glove which arguably receives the most abuse, friction, rubbing and damage. The stitching fails and the exterior insert begins to unravel, eventually coming off completely. It has been found that by removing the insert on the exterior side of the pinky finger and index finger receiving portion and replacing it with a solid piece of leather, that the problem is solved and the glove still retains the ability to tighten the glove with ease and amplifies the life expectancy of the glove.

SUMMARY OF THE INVENTION

A glove having a pinky finger, ring finger, middle finger, index finger and thumb receiving portion in communication with a hand receiving portion is provided. The pinky finger, ring finger, middle finger and index finger receiving portions each have a top panel and a bottom panel, which are connected to form each of the finger receiving portions. Each finger receiving portion includes a distal region, an intermediate region, and a proximal region, the proximal region connected to the hand receiving portion, the distal region surrounding the fingertips and the intermediate region residing about the middle knuckle (proximal interphalangeal joint) of the hand. This middle knuckle portion of each finger has an exterior and interior side (or right and left side).

As far as the middle finger goes, the exterior side and the interior side are interchangeable. As far as the pinky finger and the ring finger goes, the interior side is that side closest to the middle finger and the exterior side is that side closest to the outside of the hand. As far as the index finger is concerned, the interior side is that side closest to the middle finger and the exterior side is that side closest to the outside of the hand or the thumb. This works for both the right and the left gloves.

The intermediate region of two of the finger receiving portions (the ring finger, middle finger) includes a first and second insert. The first and second insert are provided on both the interior and exterior sides (right and left sides).

The intermediate region of the other two finger receiving portions (the pinky and index finger) include only a first insert. This first insert is located on the interior side of the middle knuckle portion. The exterior side (or outer side) of the pinky finger and index finger receiving portions are a solid piece of leather. When constructing the glove portions of the index finger and pinky finger, the side which is not adapted to receive the insert is provided with extra material. This permits the index finger and pinky finger portions of the glove to be symmetric once the flexor insert is affixed.

Again, both the first and second inserts are generally of a triangular shape and provided directly or proximal the bottom panel. The inserts are sewn in the bottom panel after the bottom panel has, been rotated to approximate the bending of the middle knuckle (proximal interphalangeal joint) of the finger.

The pinky and index finger receiving portions are again only to have a first insert which is adapted to be received on the side of the finger closest to the adjacent finger. The pinky finger and index finger receiving portions which do not reside next to a finger does not have a second insert, as the other two fingers do.

It has been found if an insert was provided in these regions, that the stitching would fail and the glove would tear apart. By keeping the side of the finger receiving portions which intersect with the environment a solid piece of leather, the glove lasts longer and has greater comfort of wear. This permits the wearer to close his hand about an object without stretching the glove intermediate regions. This permits the wearer to tighten his grip with greater ease and increases the life expectancy of the glove.

BRIEF DESCRIPTION OF THE DRAWINGS

The invention will be better understood and the above objects as well as objects other than those set forth above will be more apparent after a study of the following detailed description thereof. Such description makes reference to the annexed drawings wherein.

DETAILED DESCRIPTION OF THE FIGURES

With reference now to the drawings, a glove with inserts on the finger portions embodying the principles and concepts of the present invention will be described. Such gloves may be comprised of leather for outdoor use. Other applications would include the glove being comprised of special materials for firefighting, scuba or deep sea diving, and aerospace use. Gloves having the selected inserts may be used in golfing, motorcycling, bicycling, gardening, farming, animal husbandry, as well as for cold weather. The gloves having selected inserts may be employed anywhere an ordinary glove may be employed.

Figure 1:
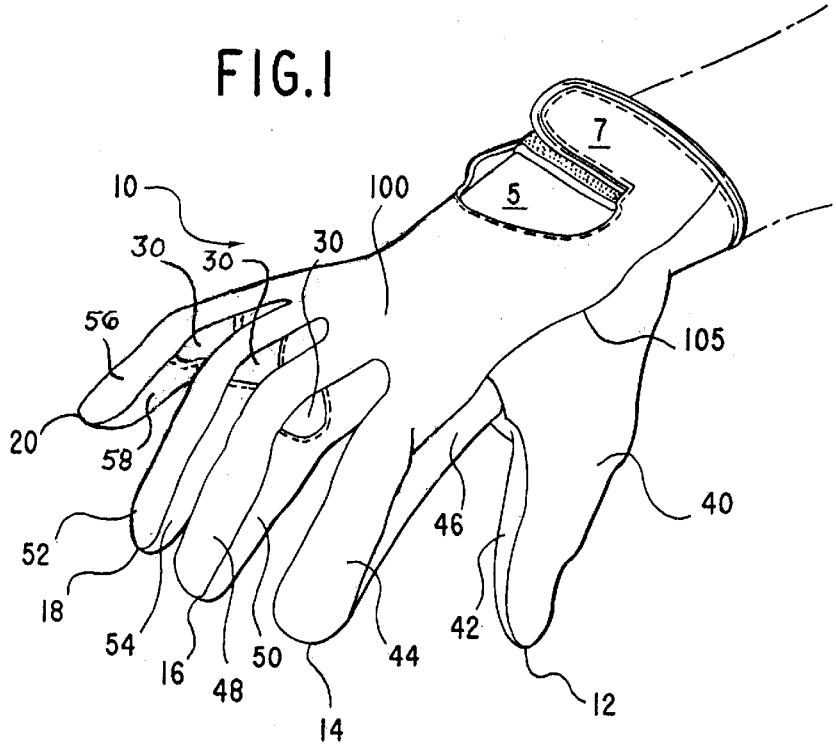
FIG. 1 is a view of the glove with selective inserts, the glove being worn on the hand.
Figure 2:
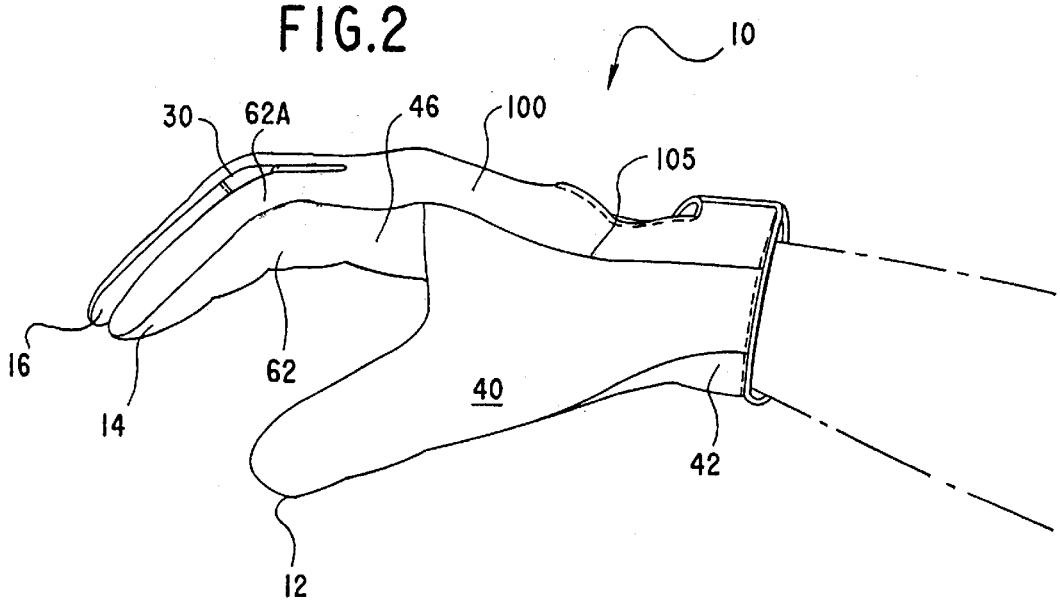
FIG. 2 is a side view of the glove with selective inserts, the glove being worn on the hand.
Figure 10:
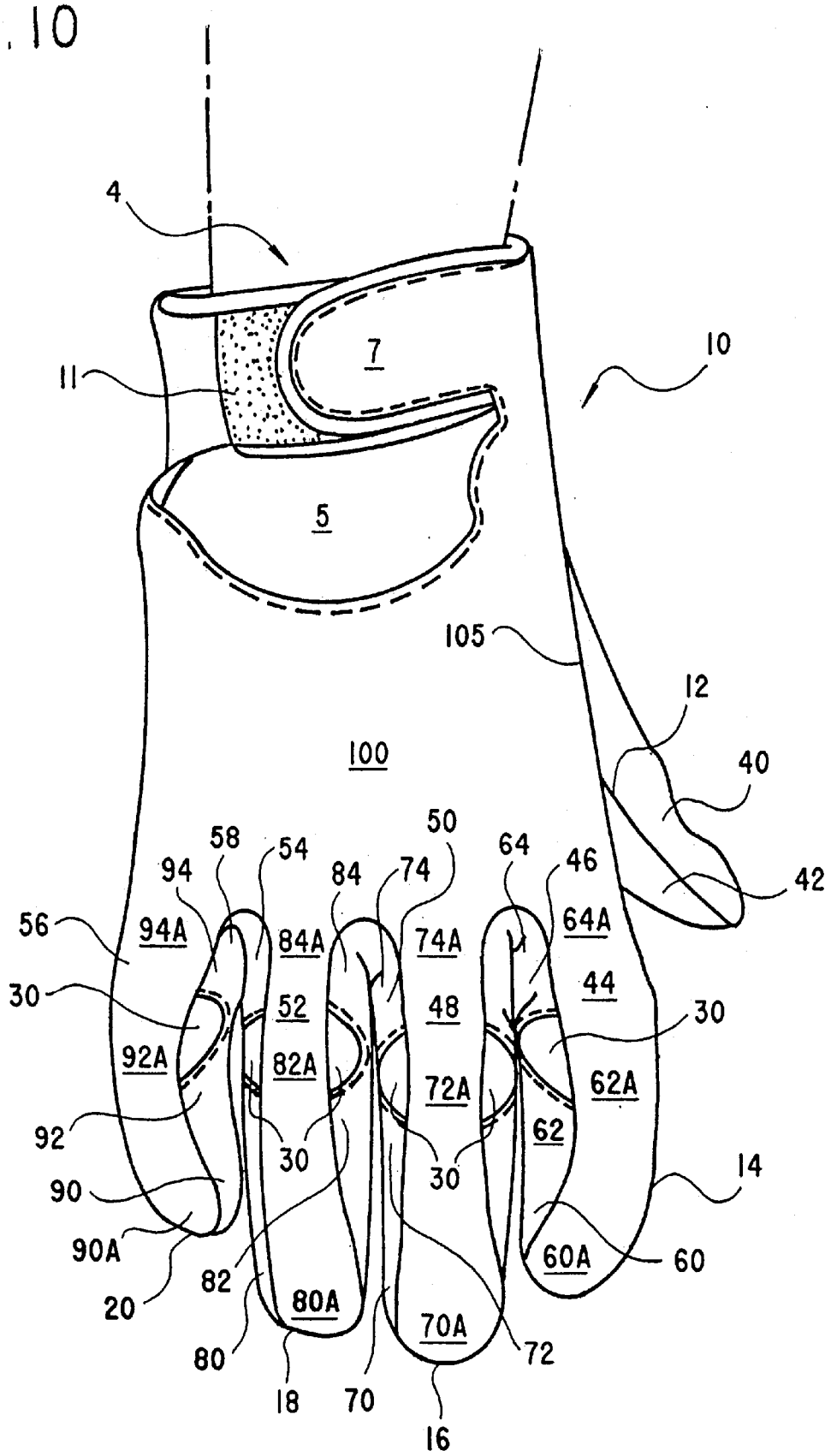
FIG. 10 is a top view of the glove with specialized and selective inserts.

Turning initially to FIGS. 1, 2 and 10, there is shown the glove with inserts 30 on the finger portions generally designated by reference numeral 10. In its preferred form, glove 10 comprises generally a hand receiving portion 100, a thumb receiving portion 12, an index finger (or forefinger) receiving portion 14, a middle finger receiving portion 16, a ring finger receiving portion 18 and a pinky (or small) finger receiving portion 20. The glove 10 may include an opening 5 generally proximal the wrist 4, or may not have an opening at all. In certain embodiments, the glove 10 may be secured about the wrist 4 by flap 7, which may close about the wrist and be secured thereto by hook and loop fasteners 11 or other equivalent means.

The thumb receiving portion 12 includes a top panel 40 and a bottom panel 42. The thumb receiving portion top panel 40 and bottom panel 42 are sewn together and are connected to the hand receiving portion 100 about sew line 105. The thumb receiving portion 12 does not include any inserts.

The index finger receiving portion 4 includes a top panel 44 and a bottom panel 46. The index finger receiving portion 14 bottom panel 46 has a distal member 60, an intermediate member 62 and a proximal member 64. The index finger receiving portion 14 top panel 44 has a distal member 60A, an intermediate member 62A and a proximal member 64A. A flexor insert 30 is provided on the side of the index finger 14 closest to the middle finger 16. The flexor insert 30 is sewn to the bottom panel 46 proximal intermediate member 62. There is no flexor insert 30 located on the side closest to the thumb receiving portion 12. It has been found if the insert 30 was provided on the side of the index finger receiving portion 14 closest to the thumb receiving portion 12, that the stitching would fail and the glove 10 would tear apart. By keeping the side of the index finger receiving portion 14 which intersects with the environment as a solid piece of leather, it has been found that the glove 10 lasts longer and has greater comfort of wear. This permits the wearer to close his hand about an object without stretching the glove intermediate regions. This permits the wearer to tighten his grip with greater ease and increases the life expectancy of the glove 10.

The middle finger receiving portion 16 includes a top panel 48 and a bottom panel 50. The middle finger receiving portion 16 bottom panel 50 has a distal member 70, an intermediate member 72 and a proximal member 74. The middle finger receiving portion 16 top panel 48 has a distal member 70A, an intermediate member 72A and a proximal member 74A. Incorporated on both the right and left sides of the bottom panel 50 intermediate member 72 is a flexor insert 30. The middle finger receiving portion 16 has a flexor insert 30 on both sides.

The ring finger receiving portion 18 includes a top panel 52 and a bottom panel 54. The ring finger receiving portion 18 bottom panel 54 has a distal member 80, an intermediate member 82 and a proximal member 84. The ring finger receiving portion 18 top panel 52 has a distal member 80A, an intermediate member 82A and a proximal member 84A. Incorporated on both the right and left sides of the bottom panel 54 intermediate member 82 is a flexor insert 30. The ring finger receiving portion 18 has a flexor insert 30 on both sides.

The pinky finger receiving portion 20 includes a top panel 56 and a bottom panel 58. The pinky finger receiving portion 20 bottom panel 58 has a distal member 90, an intermediate member 92 and a proximal member 94. The pinky finger receiving portion 20 top panel 56 has a distal member 90A, an intermediate member 92A and a proximal member 94A. A flexor insert 30 is provided on the side of the pinky finger receiving portion 20 closest to the ring finger receiving portion 18. The flexor insert 30 is sewn to the bottom panel 58 proximal intermediate member 92. There is no flexor insert 30 located on the side of the pinky receiving portion which resides next to the environment. It has been found that if the insert 30 was provided on the side of the pinky receiving portion 20 closest to the environment, that the stitching would fail and the glove 10 would tear apart. By keeping the side of the pinky finger receiving portion 20 which intersects with the environment as a solid piece of leather, the glove 10 lasts longer and has greater comfort of wear. This permits the wearer to close his hand about an object without stretching the glove intermediate regions. This permits the wearer to tighten his grip with greater ease and increases the life expectancy of the glove 10.

Figure 3:
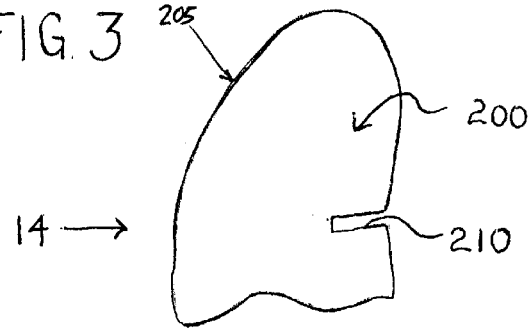
FIG. 3 is a view of the pattern used for the bottom panel of the glove adapted to receive the index finger of the left hand, including the aperture designed to receive the insert.
Figure 3A:
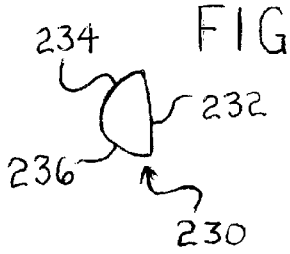
FIG. 3A is a view of the flexor insert.
Figure 3B:
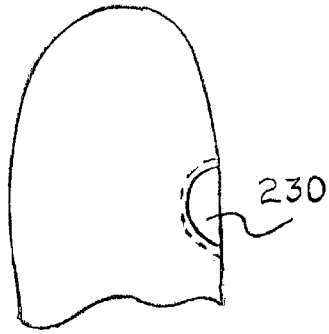
FIG. 3B is a view of the flexor insert sewn into the bottom panel of the glove adapted to receive the index finger of the left hand.

Referring now specifically to FIGS. 3, 3A & 3B, a section of the index finger receiving portion 14 is shown as well as the manner of attachment of the flexor element 230. This would be a view of the index finger receiving portion of the right hand.

The manner of attachment of the flexor element 230 shown FIG. 3 includes a bottom portion 200 of the index finger receiving portion 14, prior to the flexor insert 230 being affixed. A right cut 210 is made in the bottom portion 200. Portion 205 appears generally arcuate as extra material is provided. This extra material at 205 permits the bottom portion 200 to be symmetrical as shown in FIG. 3B when the flexor insert 230 is affixed.

In order to affix the flexor insert 230, the bottom portion is rotated downwardly, simulating the rotation of the knuckle when the hand is clenched. When in this position, the right cut 210 elongates, and the flexor insert 230 is sewn onto both the right cut 210 as shown in FIG. 3B. The bottom portion 200 is then relaxed to its normal position and sewed to the top portion forming the index finger receiving portion 14. FIG. 3*a* shows the flexor insert 230. The flexor insert 230 has a generally rounded triangular configuration with a straight side 232 and a second side 234 and a third side 236. The flexor insert 230 may have other similar configurations including, but not limited to, a half-circle, a sinusoidal portion, a rectangular element, a half-hexagonal element, a half octagonal element, a scalloped portion etc. In one embodiment, the flexor insert 230 has a generally similar appearance to that shown in FIG. 3A.

Figure 4:
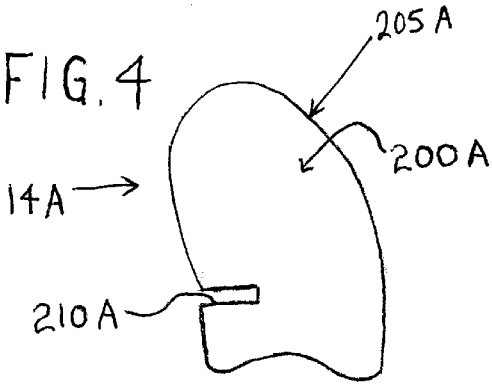
FIG. 4 is a view of the pattern used for the bottom panel of the glove adapted to receive the index finger of the right hand, including the aperture designed to receive the insert.
Figure 4A:
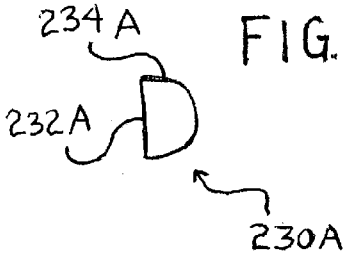
FIG. 4A is a view of the flexor insert.
Figure 4B:
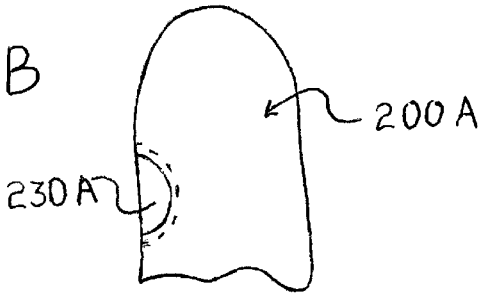
FIG. 4B is a view of the flexor insert sewn into the bottom panel of the glove adapted to receive the index finger of the right hand.

Referring now specifically to FIGS. 4, 4A & 4B, a section of the index finger receiving portion 14A is shown as well as the manner of attachment of the flexor element 230A. This would be a view of the index finger receiving portion of the left hand.

The manner of attachment of the flexor element 230A shown FIGS. 4, 4A & 4B includes a bottom portion 200A of the left hand index finger receiving portion 14A, prior to the flexor insert 230A being affixed. A left cut 210A is made in the bottom portion 200A. Portion 205A appears generally arcuate as extra material is provided. This extra material at 205A permits the bottom portion 200A to be symmetrical as shown in FIG. 4B when the flexor insert 230A is affixed.

The bottom portion is rotated downwardly, simulating the rotation of the knuckle when the left hand is clenched. When in this position, the left cut 210A elongates, and the flexor insert 230A is sewn onto both the left cut 210 as shown in FIG. 4B. The bottom portion 200A is then relaxed to its normal position and sewed to the top portion forming the left hand index finger receiving portion 14A. FIG. 4A shows the flexor insert 230A. The flexor insert 230A has a generally rounded triangular configuration with a straight side 232A and a second side 234A and a third side 236A. The flexor insert 230A may have other similar configurations including, but not limited to, a half-circle, a sinusoidal portion, a rectangular element, a half-hexagonal element, a half octagonal element, a scalloped portion etc. In one embodiment, the flexor insert 230A has a generally similar appearance to that shown in FIG. 4A.

In a very similar fashion, a single flexor insert is affixed to the pinky finger of both hands. The flexor insert is attached to the side of the pinky finger closest to that of the ring finger. The side of the pinky finger on both hands which is not adjacent to the ring finger is comprised of solid leather. FIGS. 3, 3A, & 3B could easily represent the glove portion provided for the pinky finger of the left hand. FIGS. 4, 4A, & 4B could easily represent the glove portion provided for the pinky finger of the right hand.

Figure 5:
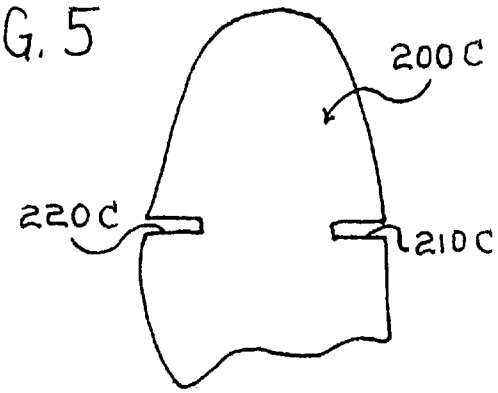
FIG. 5 is a view of the pattern used for the bottom panel of the glove adapted to receive either the ring finger or the middle finger, including the apertures designed to receive the inserts. This pattern is equivalent for both hands.
Figure 5A:
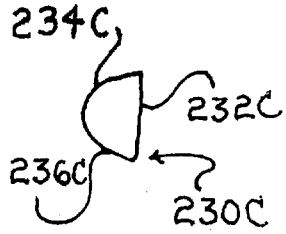
FIG. 5A is a view of the flexor insert.
Figure 5B:
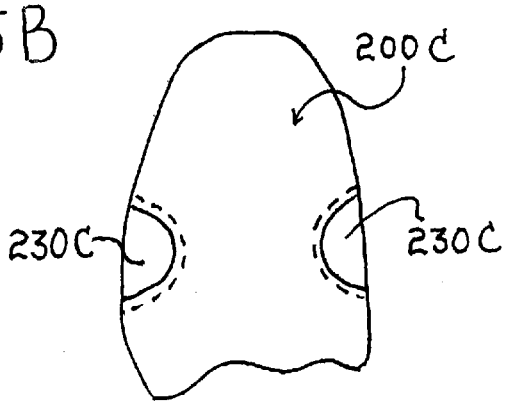
FIG. 5B is a view of the right and the left inserts being sewn into the bottom panel of the glove adapted to receive either the ring finger or the middle finger. This view is equivalent for both hands.

Turning now to FIGS. 5, 5A, & 5B the manner of attachment of the flexor element in the glove portion provided for the ring finger and middle finger of both hands is shown. FIG. 5 shows a bottom portion 200C of either the ring or middle finger receiving portions, prior to the flexor insert being affixed. A right cut 210C and a left cut 220C are made in the bottom portion 200C. The bottom portion is rotated downwardly, simulating the rotation of the knuckle when the hand is clenched. When in this position, both the right cut 210C and the left cut 220C elongate, and the flexor insert 230C is sewn onto both the right cut and the left cut, as shown in FIG. 5B. The bottom portion 200C is then relaxed to its normal position and sewed to the top portion forming one of either the ring or middle finger receiving portions. FIG. 5A shows the flexor insert 230C. The flexor insert 230C has a generally rounded triangular configuration with a straight side 232C and a second side 234C and a third side 236C. The flexor insert 230C may have other similar configurations including, but not limited to, a half-circle, a sinusoidal portion, a rectangular element, a half-hexagonal element, a half octagonal element, a scalloped portion etc. In one embodiment, the flexor insert 230C has a generally similar appearance to that shown in FIG. 5A.

Figure 6A:
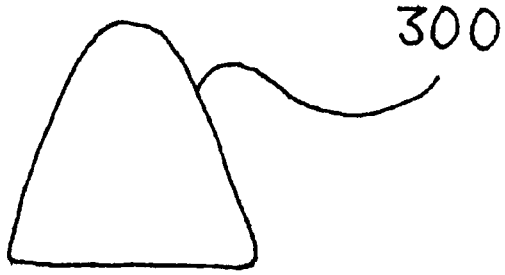
FIG. 6A shows a view of the flexor insert in a generally sinusoidal configuration.

FIG. 6A shows a view of the flexor insert 300 having a generally sinusoidal configuration.

Figure 6B:
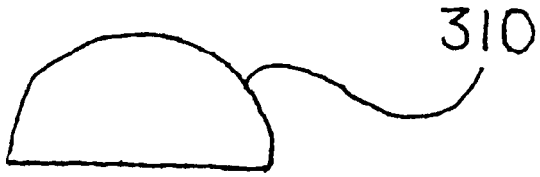
FIG. 6B shows a view of the flexor insert in a generally half-circular configuration.

FIG. 6B shows a view of the flexor insert 310 having a generally half-circular configuration.

Figure 6C:
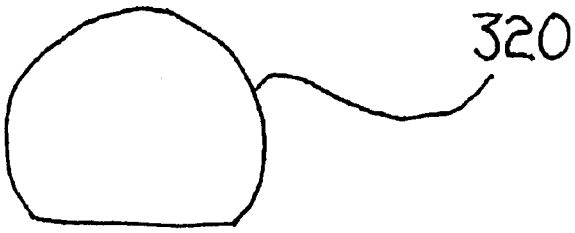
FIG. 6C shows a view of the flexor insert in a generally scalloped configuration.

FIG. 6C shows a view of the flexor insert 320 having a generally scalloped configuration. It is to be understood that other flexor insert configurations may be desirable for different types of gloves.

Figure 7A:
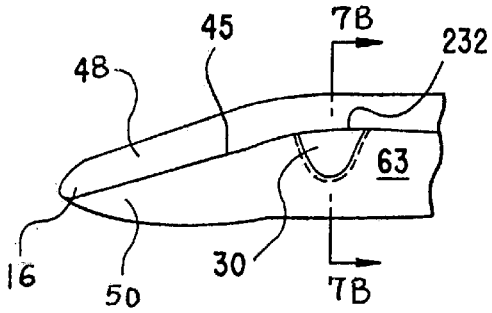
FIG. 7A is a side view of the portion of the glove adapted to receive the ring or middle finger showing the insert.

FIG. 7A shows the middle finger receiving portion 16 including the top panel 48 and the bottom panel 50. The insert 30 is shown sewn on the side of the bottom panel 50. Bottom panel 50, including the long side 232 of the insert 30 are sewn to the top panel 48 along line 45 forming the middle finger receiving portion 16. This assembly is identical for both the right and left sides of the middle finger receiving portion 16 and for that matter, except for dimension, for the ring finger receiving portion 18 as well. This structure is the same for both the glove which would be placed on both the right and the left hand.

Figure 7B:
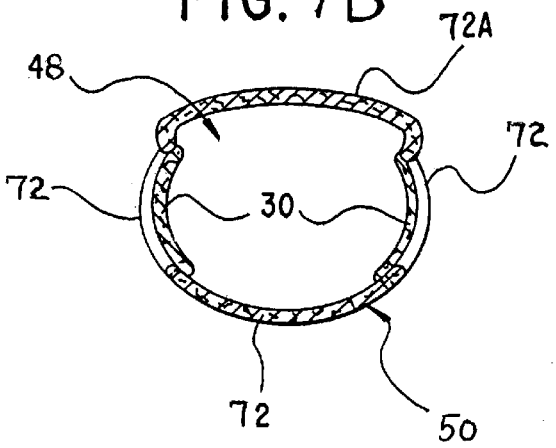
FIG. 7B is a cross-sectional view of the glove adapted to receive the ring or middle finger taken along line 7*b*—7*b* of FIG. 7A.

FIG. 7B is a cut-away view taken along line 7B—7B of FIG. 7A. The intermediate portion 72*a* of the top panel 48 and the intermediate portion 72 of the bottom panel 50 are shown. Insert 30 is shown connected on both the right and left sides of the bottom panel 50. Element 73 on the right and left side are merely material located behind the insert 30, in communication with the bottom panel 50. Again, this view would be substantially identical if taken along middle finger receiving portion or the ring finger receiving portion.

Figure 8A:
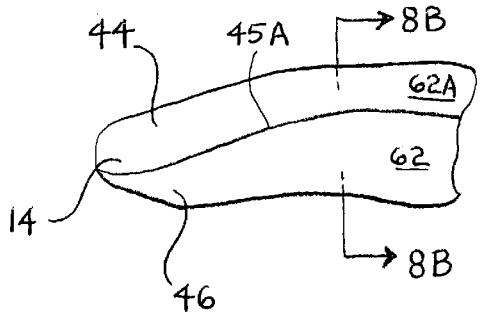
FIG. 8A is a side view of the portion of the glove adapted to receive the index finger showing the outer side, the outer side not having the insert.
Figure 8B:
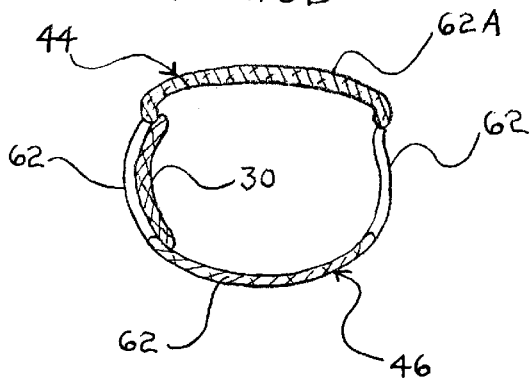
FIG. 8B is a cross-sectional view of the portion of the glove adapted to receive the index finger taken along line 8B—8B of FIG. 7A.

Referring now to FIG. 8A, the index finger receiving portion 14 for the right hand is shown. As can be clearly seen, there is no flexor insert 30 on the side of the index finger receiving portion 14 closest to the thumb 12. Rather, the flexor insert 30 is on the index finger receiving portion 14 closest to the middle finger 16 as best seen in FIG. 8B. Bottom panel 46 is sewn to the top panel 44 along line 45A forming the index finger receiving portion 14. The intermediate portion 62A of the top panel 44 and the intermediate portion 62 of the bottom panel 46 are shown.

FIG. 8B is a cut-away view taken along line 8B—8B of FIG. 8A. The intermediate portion 62A of the top panel 44 and the intermediate portion 62 of the bottom panel 46 are shown. Insert 30 is shown connected on the right side of the bottom panel 46. Element 62 on the right and left side are material and on the right side element 62 is immediately proximal the insert 30, in communication with the bottom panel 46. This view would be substantially identical for the pinky finger 20 of the left hand.

Figure 9A:
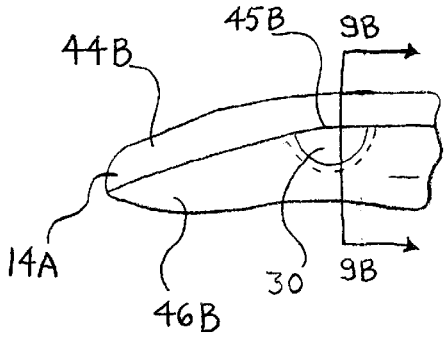
FIG. 9A is a side view of the portion of the glove adapted to receive the index finger showing the inner side, the inner side having the insert.
Figure 9B:
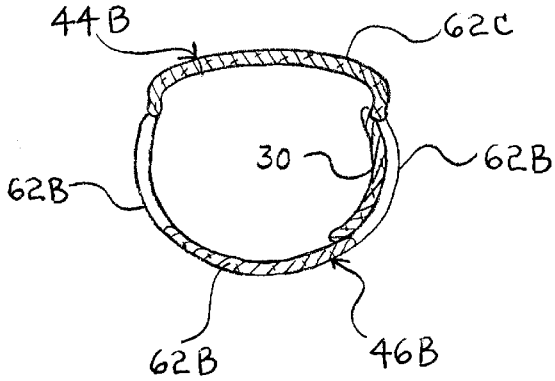
FIG. 9B is a cross sectional view of the portion of the glove adapted to reciev the index finger taken along 9B—9B of FIG. 9A.

Referring now to FIG. 9A, the index finger receiving portion 14A for the left hand is shown. Here, there is a flexor insert 30 on the side of the index finger receiving portion 14A closest to the index finger 16A. Bottom panel 46A is sewn to the top panel 44A along line 45B forming the index finger receiving portion 14 for the left hand. The intermediate portion 62A of the top panel 44 and the intermediate portion 62 of the bottom panel 46 are shown.

FIG. 8B is a cut-away view taken along line 8B—8B of FIG. 8A. The intermediate portion 62A of the top panel 44B and the intermediate portion 62 of the bottom panel 46B are shown. Insert 30 is shown connected on the left side of the bottom panel 46B. Element 62B on the right and left side are material and on the left side element 62 is immediately proximal the insert 30, in communication with the bottom panel 46B. This view would be substantially identical for the pinky finger 20 of the right hand.

The instant gloves and inserts may be manufactured from any of a wide variety of materials. These include, but are not limited to, cowhide, leathers, deer skin, goat hide, elk hide, fabrics and the like. Fireproof materials may be employed. Further, insulation may be provided inside the glove as is well known in the art.

The instant gloves may be further treated to enhance their resistance to water, to alter their heat transfer characteristics, and to reduce their susceptibility to wear. Coloring agents may also be employed to alter the color.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

what is claimed as being new and desired to be protected by Letters Patent of the United States is as follows:

1. A glove for covering the right hand, said glove having a thumb receiving portion, an index finger receiving portion, a middle finger receiving portion, a ring finger receiving portion and a pinky receiving portion, said index receiving portion having a top panel and a bottom panel, said middle finger receiving portion having a top panel and a bottom panel, said ring finger having a top panel and a bottom panel, said pinky finger having a top panel and a bottom panel, said index finger bottom portion having an intermediate region, said middle finger bottom portion having an intermediate region, said ring finger bottom portion having an intermediate region, said pinky finger bottom portion having an intermediate region, said index finger bottom portion intermediate region having a right and a left side, said middle finger bottom portion intermediate region having a right and a left side, said ring finger bottom portion intermediate region having a right and a left side, said pinky finger bottom portion intermediate region having a right and a left side, said index finger bottom portion intermediate region including a single insert, said single insert located on said right side, and no insert located on said left side said middle finger bottom portion intermediate region right side including an insert, said middle finger bottom portion intermediate region left side including an insert, said ring finger bottom portion intermediate region right side including an insert, said ring finger bottom portion intermediate region left side including an insert, said pinky finger bottom portion intermediate region including a single insert, said single insert located on said left side, and no insert located on said right side said index finger top panel connected to said index finger bottom panel, said middle finger top panel connected to said middle finger bottom panel, said ring finger top panel connected to said ring finger bottom panel, said pinky finger top panel connected to said pinky finger bottom panel, whereby when said index finger receiving portion, said middle finger receiving portion, said ring finger receiving portion and said pinky finger receiving portion are closed about an object, the index finger top panel, the middle finger top panel, the ring finger top panel and the pinky top finger panel are not stretched.

2. A glove for covering the left hand, said glove having a thumb receiving portion, an index finger receiving portion, a middle finger receiving portion, a ring finger receiving portion and a pinky receiving portion, said index receiving portion having a top panel and a bottom panel, said middle finger receiving portion having a top panel and a bottom panel, said ring finger having a top panel and a bottom panel, said pinky finger having a top panel and a bottom panel, said index finger bottom portion having an intermediate region, said middle finger bottom portion having an intermediate region, said ring finger bottom portion having an intermediate region, said pinky finger bottom portion having an intermediate region, said index finger bottom portion intermediate region having a right and a left side, said middle finger bottom portion intermediate region having a right and a left side, said ring finger bottom portion intermediate region having a right and a left side, said pinky finger bottom portion intermediate region having a right and a left side, said index finger bottom portion intermediate region including a single insert, said single insert located on said left side, and no insert located on said right side said middle finger bottom portion intermediate region right side including an insert, said middle finger bottom portion intermediate region left side including an insert, said ring finger bottom portion intermediate region right side including an insert, said ring finger bottom portion intermediate region left side including an insert, said pinky finger bottom portion intermediate region including a single insert, said single insert located on said right side, and no insert located on said left side said index finger top panel connected to said index finger bottom panel, said middle finger top panel connected to said middle finger bottom panel, said ring finger top panel connected to said ring finger bottom panel, said pinky finger top panel connected to said pinky finger bottom panel, whereby when said index finger receiving portion, said middle finger receiving portion, said ring finger receiving portion and said pinky finger receiving portion are closed about an object, the index finger top panel, the middle finger top panel, the ring finger top panel and the pinky top finger panel are not stretched.

3. A glove for covering a hand including four fingers and a thumb, each of the four fingers having a middle knuckle portion, said glove having a first finger receiving portion, said first finger receiving portion adjacent said thumb, said first finger receiving portion having a top side, a bottom side, a thumb side and an inner side, said bottom side said inner side including a sole insert proximal the middle knuckle portion, and no insert located on said outer side, said glove further includes a second finger receiving portion, said second finger receiving portion having a top side, a bottom side, a right side and a left side, said bottom side right side including an insert proximal the middle knuckle portion and said bottom side left side including an insert proximal the middle knuckle portion.

4. A glove as claimed in claim 3 wherein said glove further includes a third finger receiving portion, said third finger receiving portion having a top side, a bottom side, a right side and a left side, said bottom side right side including an insert proximal the middle knuckle portion and said bottom side left side including an insert proximal the middle knuckle portion.

5. A glove as claimed in claim 4 wherein said glove further includes a fourth finger receiving portion, said fourth finger receiving portion having a top side, a bottom side, a first side adjacent said third finger and an outer side, said bottom side said first side including a sole insert proximal the knuckle portion.

6. A glove as claimed in claim 5 wherein said inserts are of a geometric configuration selected from the group consisting of a triangular element, a sinusoidal element, a half-circular element and a scalloped element.

7. A glove as claimed in claim 4 wherein said inserts are of a geometric configuration selected from the group consisting of a triangular element, a sinusoidal element, a half-circular element and a scalloped element.

8. A glove as claimed in claim 3 wherein said insert is of a geometric configuration selected from the group consisting of a triangular element, a sinusoidal element, a half-circular element and a scalloped element.

9. A glove as claimed in claim 3 wherein said inserts are of a geometric configuration selected from the group consisting of a triangular element, a sinusoidal element, a half-circular element and a scalloped element.

* * * * *